United States Patent [19]

Schambeck

[11] 4,319,374

[45] Mar. 16, 1982

[54] METHOD OF CONSTRUCTING A STAYED GIRDER BRIDGE

[75] Inventor: Herbert Schambeck, Herrsching, Fed. Rep. of Germany

[73] Assignee: Dyckerhoff & Widmann Aktiengesellschaft, Munich, Fed. Rep. of Germany

[21] Appl. No.: 179,513

[22] Filed: Aug. 19, 1980

Related U.S. Application Data

[63] Continuation of Ser. No. 964,580, Nov. 29, 1978, abandoned.

[30] Foreign Application Priority Data

Dec. 6, 1977 [DE] Fed. Rep. of Germany ..... 2754213

[51] Int. Cl.[3] ..... E01D 1/00

[52] U.S. Cl. ..... 14/1; 52/745

[58] Field of Search ..... 14/77, 1; 55/745

[56] References Cited

U.S. PATENT DOCUMENTS

| | | | |
|---|---|---|---|
| 3,685,224 | 8/1972 | Launay | 52/745 X |
| 3,707,011 | 12/1972 | Launay | 14/1 |
| 3,989,218 | 11/1976 | Muller | 14/1 |
| 4,103,861 | 8/1978 | Buchler | 14/1 |

FOREIGN PATENT DOCUMENTS

| | | | |
|---|---|---|---|
| 1237603 | 10/1967 | Fed. Rep. of Germany . | |
| 2036924 | 3/1971 | Fed. Rep. of Germany | 14/77 |
| 2056100 | 5/1971 | Fed. Rep. of Germany | 14/77 |
| 2060445 | 10/1971 | Fed. Rep. of Germany | 14/77 |
| 1283924 | 8/1972 | United Kingdom | 14/1 |

OTHER PUBLICATIONS

"Erection Methods on Baton Rouge Bridge", by E. L. Durkee; Civil Engineering 3/1941, vol. 11, No. 3 pp. 150–153.

*Primary Examiner*—Nile C. Byers, Jr.

*Attorney, Agent, or Firm*—Toren, McGeady & Stanger

[57] ABSTRACT

In constructing a stayed girder bridge, the end abutments and intermediate permanent bridge supports are built in place. The stiffening girder is formed of reinforced concrete or prestressed concrete and is built in sections at a location adjacent one of the abutments. As each section is built, it is connected to the previously produced sections by the reinforcing used, and the stiffening girder is moved from the one abutment toward the other by the length of the sections. When the girder reaches the other end abutment, a reinforced concrete tower is constructed upwardly from the girder at a location spaced from the abutments. A pair of stays are constructed of prestressed concrete each secured at one end to the other part of the tower. From the tower each stay extends in an opposite direction diagonally downwardly to and is secured to the stiffening girder.

4 Claims, 5 Drawing Figures

METHOD OF CONSTRUCTING A STAYED GIRDER BRIDGE

This is a continuation of application Ser. No. 964,580 filed on Nov. 29, 1978.

SUMMARY OF THE INVENTION

The present invention is directed to a method of constructing a stayed girder bridge which includes a stiffening girder formed of reinforced concrete or prestressed concrete, a suspension tower extending upwardly from the girder, and at least a pair of stays each secured to the upper part of the tower and each extending in an opposite direction from the tower diagonally downwardly to and anchored to the stiffening girder.

Bridge systems having a roadway girder supported by stays, such as cables or similar members, extending diagonally upwardly from the girder to a tower, can be constructed either as cable stayed bridges or as stayed girder bridges. Each systems has different features and, as a result, different fields of utilization.

In a cable stayed bridge, the stiffening girder is supported by a plurality of inclined cables which are connected to the girder at closely spaced apart locations and are arranged on the tower or towers either parallel to one another or in a fan-like arrangement. Such a bridge is particularly suited for a free cantilever arrangement of the bridge sections. In such an arrangement, the tower or towers are constructed before or at the same time as the stiffening girder and each cantilever section or each second cantilever section is attached to the tower by the stayed members immediately after the concrete has been poured. Accordingly, such a construction sequence immediately provides the final structure without any additional auxiliary construction measures. Due to the multitude of the stays or tension members and the small spacing between their anchorages to the stiffening girder, their structural height is small. A stayed girder bridge has, as a rule, only one concentrated stay member secured to the tower. Accordingly, the distance between its anchoring points is large. Therefore, the bridge requires a relatively large constructional height so that a free span between supports can be bridged.

For the construction of a stayed girder bridge there is not as favorable a production method as, for example, the cantilever arrangement for a cable stayed bridge. The construction of the stiffening girder of a stayed girder bridge on conventional falsework has the usual disadvantages, such as high costs for the falsework, and does not allow an economical construction operation in short repetitive work cycles. It is possible to construct the stiffening girder in cantilevered sections, however, there is the disadvantage that the stiffening girder must first be suspended from the permanent tower or from temporary towers by means of temporary stays and the final stays can only be placed after the lower anchoring point of the stay has been reached. When these two types of stays are used, it results in additional costs.

In constructing elongated structures, particularly bridges, it has been known to use an incremental launching method. In this method, successive sections of the bridge superstructure are produced by pouring concrete in a formwork located immediately adjacent one end of the structure. The section produced is connected to the previously produced sections by means of the reinforcement employed in the sections. Subsequently, the connected sections are moved, by the length of the produced section, toward the opposite end of the structure. To effect the movement, slide bearings are arranged on the support members. After the bridge superstructure is completed, the slide bearings are removed and replaced by the final bearings.

When this incremental launching method is used, frequently auxiliary supports are needed so the portion of the structure being moved, which cantilevers beyond a particular support, does not become too great. Further, it is possible to reduce these bending moments or to make the spacing between the supports greater by using a nose or projection made of a steel structure mounted on the leading end of the structure being moved. This steel structure offsets the cantilever of the girder by resting on a support and reducing the load on the girder. As can be appreciated, such a steel structure used as a projecting member is very light compared to a stiffening girder made of reinforced concrete.

Therefore, the primary object of the present invention is to provide an economical construction method for a stayed girder bridge which takes into consideration not only the static properties of the construction, but also allows the bridge to be constructed in short repetitive work cycles.

In accordance with the present invention, the stiffening girder is constructed first. The girder is formed in successive sections in formwork located immediately adjacent one end of the bridge. As it is constructed, each section is connected to the previously constructed section by the reinforcing used, whether the girder is formed of reinforcing concrete or prestressed concrete. After each section is constructed, the stiffening girder is moved toward the opposite end of the bridge by the length of the section. Permanent supports are provided between the ends of the bridge structure. Auxiliary supports are located in that region of the structure which is to be spanned by the stayed girder bridge. After the stiffening girder has been moved so that it extends from one end of the bridge structure to the other, a tower and stays are constructed with the stays connected to the stiffening girder. Finally, the temporary supports are removed.

This construction method has the advantage that the incremental launching method recognized to be economical for multi-span bridges with uniform cross section of the superstructure, can be employed for a stayed girder bridge. The span between the permanent supports for the stiffening girder can be reduced during construction by the use of temporary supports so that the bending moments which occur can be absorbed by the stiffening girder of the stayed girder bridge through the required construction height of the finished bridge, while, when the stiffening girder is finally placed in position, it can be anchored to the tower through subsequently formed stays.

The method embodying the present invention is especially advantageous in the construction of bridges having spans of significantly different lengths. Accordingly, it is possible to construct a bridge of uniform or almost uniform cross section with the use of stays only in the locations where the span between supports is great.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
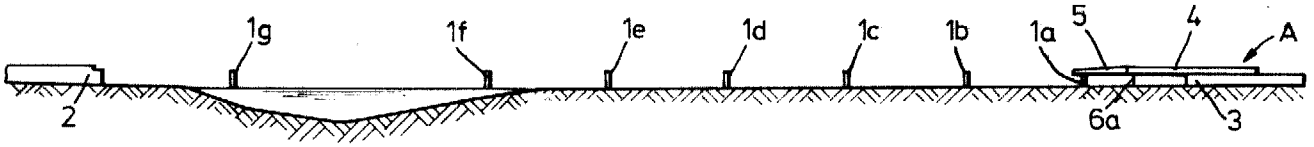
FIG. 1 is a schematic longitudinal sectional view of a bridge structure with the permanent supports in place and with the stiffening girder ready to be moved from one end toward the other.

In FIG. 1, the permanent supports for a multiple-span stayed girder bridge are illustrated with a major portion of the bridge extending over land and the remainder extending over a stream. A pair of end abutments 2,3 define the opposite ends of the bridge with bridge supports 1*a*, 1*b*, 1*c*, 1*d*, 1*e*, 1*f*, and 1*g* extending in spaced relation between the abutments. The permanent bridge supports 1*a*–1*e* are located on land while the remaining two permanent bridge supports 1*f* and 1*g* are located in the stream. In the region of the end abutment 3 there is a construction area A for producing individual sections of the superstructure 4 including the stiffening girder. The construction of the individual sections and the design of the stiffening girder with regard to its cross section and reinforcement are not the subject matter of the present invention and, accordingly, it is not necessary to illustrate or describe its section in the construction area or the formwork used for the individual superstructure sections. As can be seen at the righthand end of FIG. 1, a portion of the superstructure 4 is completed and a nose or projection 5 in the form of a steel structure extends from the leading end of the superstructure and rests on the first permanent support 1*a*. In addition, a temporary support 6*a* is located between the abutment 3 and the adjacent permanent support 1*a* to facilitate the bridging of the span between the two permanent support members.

Figure 2:
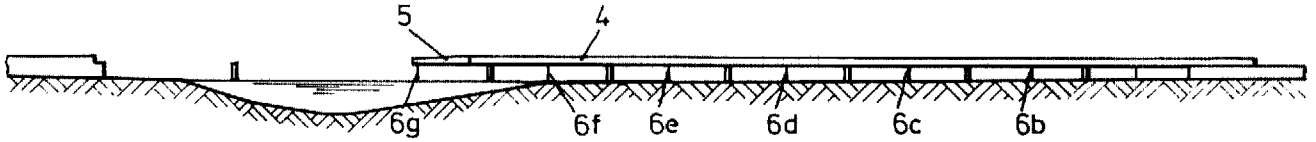
FIG. 2 is a view similar to FIG. 1 with the stiffening girder moved partially from one end support to the other.
Figure 3:
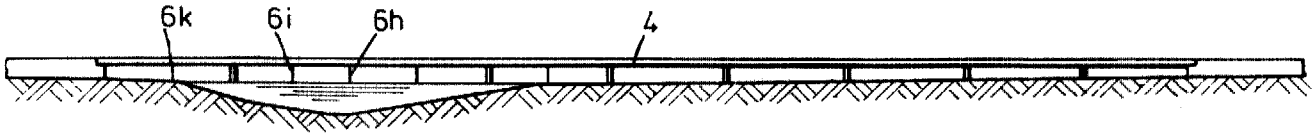
FIG. 3 is a view similar to FIGS. 1 and 2 with the stiffening girder in place between the end supports.
Figure 4:
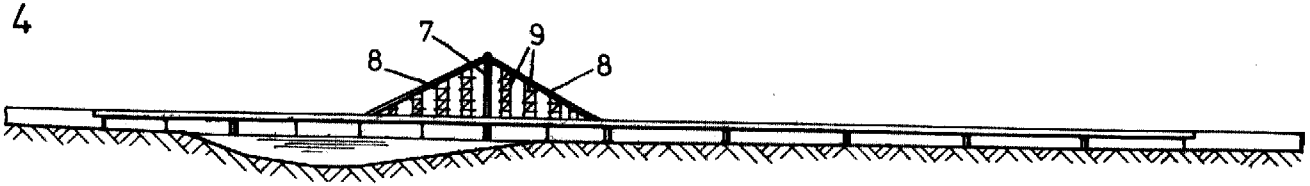
FIG. 4 is a view similar to FIG. 3 with a tower erected and stays being constructed.

In FIG. 2, the construction of the bridge has proceeded to the point where the superstructure 4 has moved forwardly from the end abutment 3 to a point just ahead of the permanent support 1*f*. The projection 5, extending forwardly from the superstructure, rests on a temporary support 6*g* located outwardly in the stream from the permanent support 1*f*. In addition to the temporary support 6*a* shown in FIG. 1, temporary supports 6*b*, 6*c*, 6*d*, and 6*e* are located between and spaced from the corresponding permanent supports. In FIG. 3 the superstructure 4 has moved forwardly to the other end abutment 2 so that the superstructure is completed. In the portion of the bridge extending over land from the end abutment 3, the temporary supports 6*a*–6*e* have been removed, however, from the righthand bank of the stream, as viewed in FIG. 3, to the abutment 2, the superstructure still rests on the temporary supports 6*f*–6*k*.

In the next step of the method of constructing the stayed girder bridge, a tower 7 is erected upwardly from the superstructure 4 directly above the permanent support 1*f*. In addition, stays 8 are supported on falsework 9 and extend diagonally downwardly from opposite sides of the upper part of the tower 7 to the superstructure 4, that is, to the stiffening girder. Preferably, the tower 7 is formed of reinforced concrete and can have any desired suitable form. In addition, the stays 8 are constructed as prestressed concrete beams and during construction are supported on the falsework 9. The stays 8 are formed of prestressed concrete in accordance with conventional construction practise and, since they are formed of concrete, they are free of maintenance as are the other parts of the bridge also constructed of reinforced or prestressed concrete. As a result, corrosion is not a problem and there are no problems of exchangeability which could occur in the case of a steel cable used as the stay.

Figure 5:
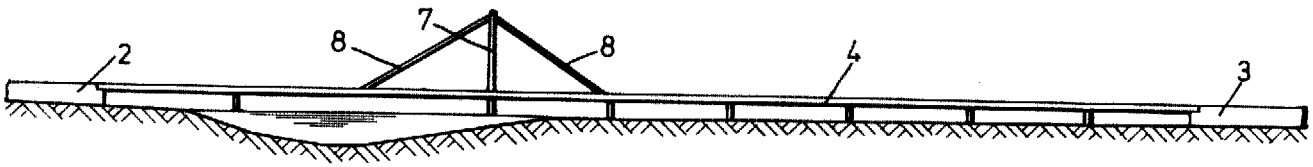
FIG. 5 is a view similar to FIG. 4 with the stayed girder bridge completed.

After the stays 8 are completed, with the necessary connection or anchorage provided to the tower and the stiffening girder, the remaining temporary supports 6*f*–6*k* are removed and the bridge, as shown in FIG. 5, is completed. In accordance with this method, the bridge can be constructed, in spite of significantly different span lengths, of a uniform constructional height and cross section over its entire length and it can be built economically without any delay in construction.

While specific embodiments of the invention have been shown and described in detail to illustrate the application of the inventive principles, it will be understood that the invention may be embodied otherwise without departing from such principles.

What is claimed is:

1. Method of constructing a stayed girder bridge, the stayed girder bridge including a first end abutment and a second end abutment spaced from the first end abutment, a plurality of spaced permanent bridge supports located between and spaced from the first and second end abutments, a stiffening girder formed of one of reinforced concrete or prestressed concrete and extending between the first and second end abutments over the bridge supports, a tower extending upwardly from the stiffening girder and located intermediate the first and second end abutments, and at least two stays each extending in an opposite direction from the upper part of the tower diagonally downward to the stiffening girder with the stays anchored both to the tower and the stiffening girder, wherein the method comprises the steps of constructing the first and second end abutments and the permanent bridge supports spaced between the abutments, constructing in series individual sections of the stiffening girder in formwork located adjacent the first end abutment, interconnecting adjacent individual sections of the stiffening girder by means of the reinforcement in the sections, moving the sectionally constructed stiffening girder in a stepwise manner out of the formwork and from the first end abutment toward the second end abutment with the movement of the girder during each step being equal to the length of the section formed, supporting the girder during movement on the permanent bridge supports and providing temporary support for the girder intermediate the permanent bridge supports, after completing the movement of the stiffening girder to the second end abutment, constructing a tower of reinforced concrete upwardly from the stiffening girder at a location spaced from the first and second end abutments and aligned above one of said permanent supports, constructing a pair of stays of prestressed concrete each connected to the tower at the upper part thereof and each extending diagonally downwardly therefrom in an opposite direction and in the length direction of said girder and connected to the stiffening girder at the lower ends thereof at spaced locations from the tower, and maintaining the temporary supports under the girder at least for the length thereof covered by the stays extending from the tower until the tower and stays are completed, and then removing the temporary supports under the length of the girder covered by the stays.

2. Method, as set forth in claim 1, including the step of placing a steel structure projection on the leading end of the stiffening girder as it is moved from the first end abutment toward the second end abutment and supporting the projection on one of the temporary and permanent bridge supports for providing support for any portion of the stiffening girder cantilevered toward the second end abutment from one of the supports.

3. Method, as set forth in claim 1, including the step of supporting the stiffening girder on slide bearings as it is moved over the permanent and temporary bridge supports and, after the stiffening girder has reached the second end abutment, removing the slide bearings and placing the stiffening girder on final bearings.

4. Method, as set forth in claim 1, including the steps of constructing formwork for forming the stays, supporting the formwork on falsework supported on the girder, and placing prestressed concrete into the formwork for forming the stays.

* * * * *